United States Patent [19]

Vom Braucke et al.

[11] Patent Number: 4,880,192

[45] Date of Patent: Nov. 14, 1989

[54] HANDLED TOOL SUSPENSION DEVICE

[75] Inventors: Hans Vom Braucke, Vlotho; Manfred Vom Braucke, Telgenbrink; Dieter Westerwelle, Markusstrasse, all of Fed. Rep. of Germany

[73] Assignee: Bielefelder Kuchenmaschinen-und Transportgerate-Fabrik Vom Braucke GmbH, Bielefeld, Fed. Rep. of Germany

[21] Appl. No.: 152,270

[22] Filed: Feb. 4, 1988

[51] Int. Cl.[4] ..... A46B 17/02

[52] U.S. Cl. ..... 248/110; 211/66; 211/70.6; 211/89; 248/309.1

[58] Field of Search ..... 248/110, 113, 316.2, 248/316.3, 316.1, 309.1; 211/70.6, 68, 65, 66, 89; 403/16; 24/612, 665, 633

[56] References Cited

U.S. PATENT DOCUMENTS

| | | | |
|---|---|---|---|
| 1,598,403 | 8/1926 | Stockard | 248/316.3 X |
| 1,686,655 | 10/1928 | Ellerbeck | 248/113 |
| 2,488,664 | 11/1949 | Gruber | 248/113 |
| 2,911,172 | 11/1959 | Clayton et al. | 248/113 |
| 4,749,160 | 6/1988 | Shih | 211/66 X |

FOREIGN PATENT DOCUMENTS

| | | | |
|---|---|---|---|
| 3217748 | 12/1982 | Fed. Rep. of Germany | 248/316.1 |
| 605636 | 5/1926 | France | 211/65 |
| 1503636 | 12/1967 | France | 248/316.3 |
| 166437 | 1/1934 | U.S.S.R. | 248/113 |
| 130951 | 5/1919 | United Kingdom | 248/294 |
| 468954 | 7/1937 | United Kingdom | 248/113 |
| 1456813 | 11/1976 | United Kingdom | 248/316.3 |

*Primary Examiner*—Alvin C. Chin-Shue
*Assistant Examiner*—David L. Talbott
*Attorney, Agent, or Firm*—Armstrong, Nikaido, Marmelstein, Kubovcik & Murray

[57] ABSTRACT

A device for suspending handled tools such as brooms, spades and rakes comprising hook means and mounting means for said hood means, said mounting means defining a pivot axis for said hook means, said pivot axis extending substantially horizontally, said hook means having a front elevation which is substantially S-shaped and comprising a mounting shaft portion located in said mounting means so as to be pivotable about said horizontal axis, a linear portion extending substantially at right angles to said mounting shaft portion in a generally downward direction, a further portion extending in a substantially horizontal plane from said linear portion, said further portion being substantially C-shaped or S-shaped in plan view, and a hook portion extending from said further portion.

8 Claims, 2 Drawing Sheets

HANDLED TOOL SUSPENSION DEVICE

FIELD OF THE INVENTION

The present invention relates to a suspension device for retaining tools provided with handles. Primarily, but not exclusively, the present invention relates to a suspension device which can be used for suspending and storing household and garden tools such as brooms, spades and rakes.

BACKGROUND OF THE INVENTION AND PRIOR ART DISCUSSION

A suspension device for such tools is known and comprises a substantially S-shaped hook which includes a mounting shaft pivotable about a horizontal axis in a mounting block or the like. A downwardly extending first rectilinear portion of the hook butts against the mounting shaft. Such a device may for example, be used to hang garden tools on a wall after use. The heads of such tools, which are frequently made of steel or bristles are thus suspended so as to be clear of the floor. If the tool head is wet, the moisture thereon will dissipate better if it is suspended than if it was located on the floor. This obviously discourages the formation of rust.

In such a known device, the tool is retained in the hook by two opposed points of contact between the hook and the tool, solely by means of frictional forces. A spring is, therefore, often provided to change the position of the tool handle within the hook so as to make it more difficult for the handle to fall out of the hook when the latter is shaken or otherwise displaced and the frictional retention forces are thus reduced. Such an arrangement is, however, relatively complicated to construct.

OBJECT OF THE INVENTION

The present invention seeks to provide a device which is generally of the above-described type but which is provided with an improved hook of simple construction to increase the frictional forces between the hook and the handle of the tool such that the handle sits more firmly in the hook.

SUMMARY OF THE INVENTION

According to the present invention there is provided a device for suspending handled tools such as brooms, spades and rakes comprising hook means and mounting means for said hook means, said mounting means defining a pivot axis for said hook means, said pivot axis extending substantially horizontally, said hook means having a front elevation which is substantially S-shaped and comprising a mounting shaft portion located in said mounting means so as to be pivotable about said horizontal axis, a linear portion extending substantially at right angles to said mounting shaft portion in a generally downward direction, a further portion extending in a substantially horizontal plane from said linear portion, said further portion being substantially C-shaped in plan view, and a hook portion extending from said further portion.

Also according to the present invention, there is provided a device for suspending handled tools such as brooms, spades and rakes comprising hook means and mounting means for said hook means, said mounting means defining a pivot axis for said hook means, said pivot axis extending substantially horizontally, said hook means having a front elevation which is substantially S-shaped and comprising a mounting shaft portion located in said mounting means so as to be pivotable about said horizontal axis, a linear portion extending substantially at right angles to said mounting shaft portion in a generally downard direction, a further portion extending in a substantially horizontal plane from said linear portion, said further portion being substantially S-shaped in plan view and a hook portion extending from said further portion. By providing such arrangement, the handle of the tool can lie against the concave upper surface of the S-shaped or partially circular bow-shaped, portion, that is to say C-shaped, so that lateral movement of the handle out of the hook is almost impossible.

In known devices, the hook is of a U-shaped construction. It is therefore completely open in one direction and the handle can also move laterally out of the hook if it is shaken. In the arrangements according to the present invention, such unintentional displacement of the handle from the hook is not possible.

Advantageously, said hook portion includes a first portion extending substantially at right angles to said further portion.

Preferably, said hook portion further includes a continuously curved three-dimensional hook extending from said first hook portion, said hook being directed generally inwardly. Thus the handle of a tool lies in the hook with a further point of contact against a concave line and is thus surrounded by the hook on at least three sides so that any lateral movement of the handle tending to displace it from the hook is prevented. The hook has an involute form so that its individual components do not extend in a single plane, but extend in three dimensions. In particular the three-dimensional portion is bent upwardly at its free end and is at the same time bent rearwardly.

The radius of curvature of the S-shaped or C-shaped portion corresponds approximately to the curvature of the surface of the handle. The radius of curvature of the S-shaped and C-shaped portion can, however, be somewhat larger than the curvature of the surface of the handle, if this is desired.

The handle thus has a linear contact with both the C-shaped and S-shaped portion of the hook and with its lower three dimensionally curved portion.

A device according to the invention has the advantage that the handle is supported within the hook by at least three points or lines of contact. In addition to the point of contact with the S-shaped or partially circular C-shaped portion and the point of contact with the three-dimentional portion, there is also a lateral point or line of contact with the second linear portion of the hook member because the handle is pressed against such portion as a result of the bowed construction of the remaining portion. The handle will then lie at a substantially acute angle to the longitudinal direction of the central portion.

BRIEF DESCRIPTION OF THE DRAWINGS

Two embodiments of a device in accordance with the present invention will be further described, by way of example, with reference to the accompanying drawings, in which.

DESCRIPTION OF PREFERRED EMBODIMENTS

Figure 1:
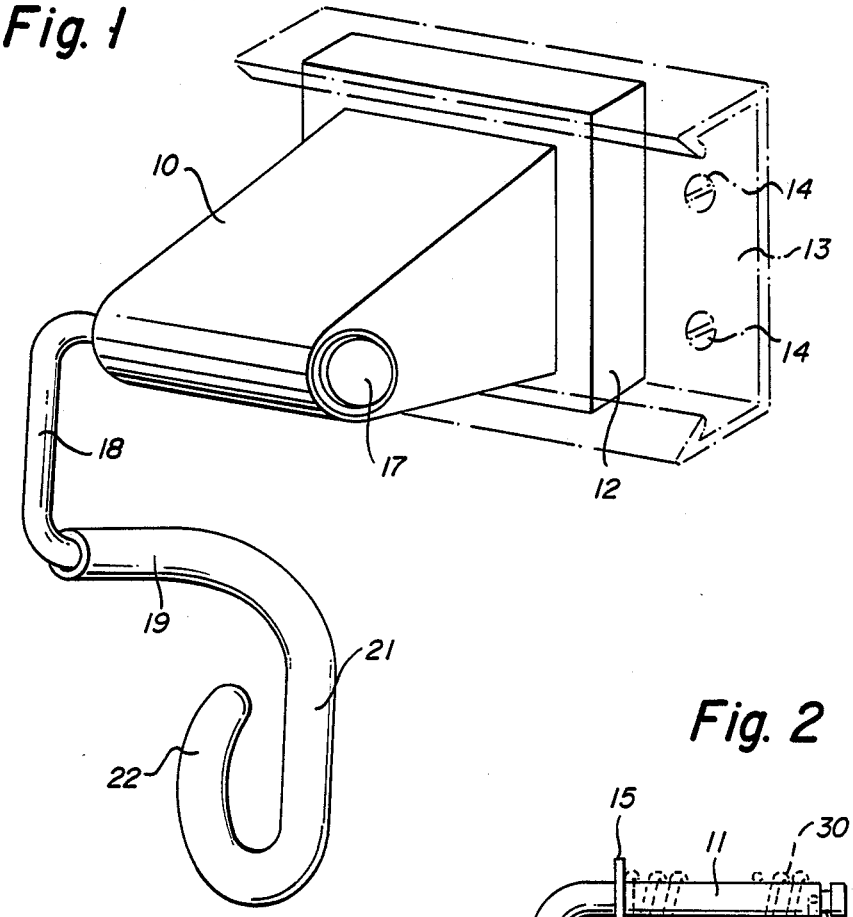
FIG. 1 is a perspective view of a first embodiment of a device in accordance with the present invention in its inoperative position.
Figure 2:
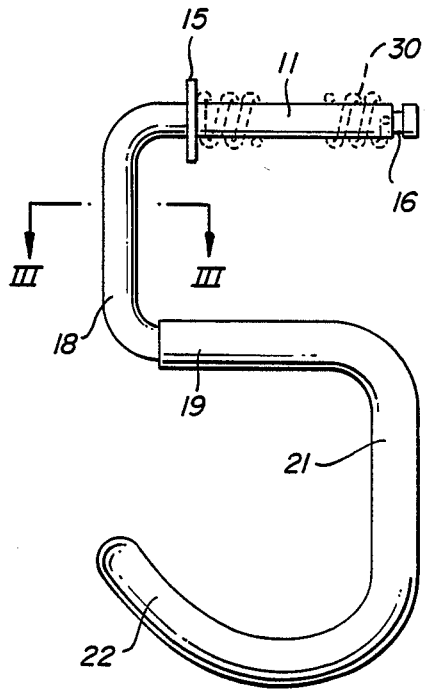
FIG. 2 is a front elevational view of the hook portion of the device shown in FIG. 1.
Figure 3:
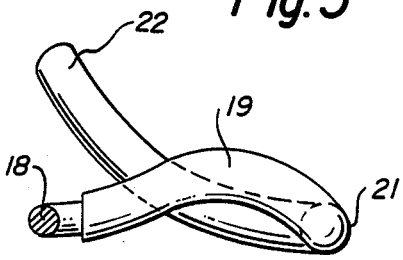
FIG. 3 is a vertical cross-sectional view through the hook portion taken along the line III—III in FIG. 2.

In FIGS. 1 to 3, there is shown a device for suspending tools by means of their handles. As shown, the device comprises a mounting block 10 in which a mounting shaft 11 of a generally C-shaped hook arrangement is pivotally mounted. The shaft 11 extends substantially horizontally. The block 10 includes a rectangular slider member 12 which is guided in a horizontally extending rail assembly 13 which permits the block to be displaced in a horizontal direction. The rail assembly 13 may be secured to a wall by means of, for example, screws 14.

Around the end of the shaft 11, the left-hand end as shown, connected to the remainder of the hook assembly is a fixed collar 15 shown in FIG. 2 of the drawings. This may be used to retain one end of a coil spring 30 (shown in dotted lines) fitted on the mounting shaft 11. The mounting shaft 11 and the spring 30 are inserted from the left hand side into a horizontally extending aperture formed in the mounting block 10 until the shaft 11 is located in the position shown in FIG. 1. The other end of the coil spring is affixed in the mounting block 10 so that it acts on the mounting shaft 11 to cause this latter to tend to pivot towards the wall. A cap 17 may be inserted into a groove 16 formed in the free end of the mounting shaft 11. This secures and axially locates the mounting shaft 11 of the hook assembly in the mounting block 10.

Figure 4:
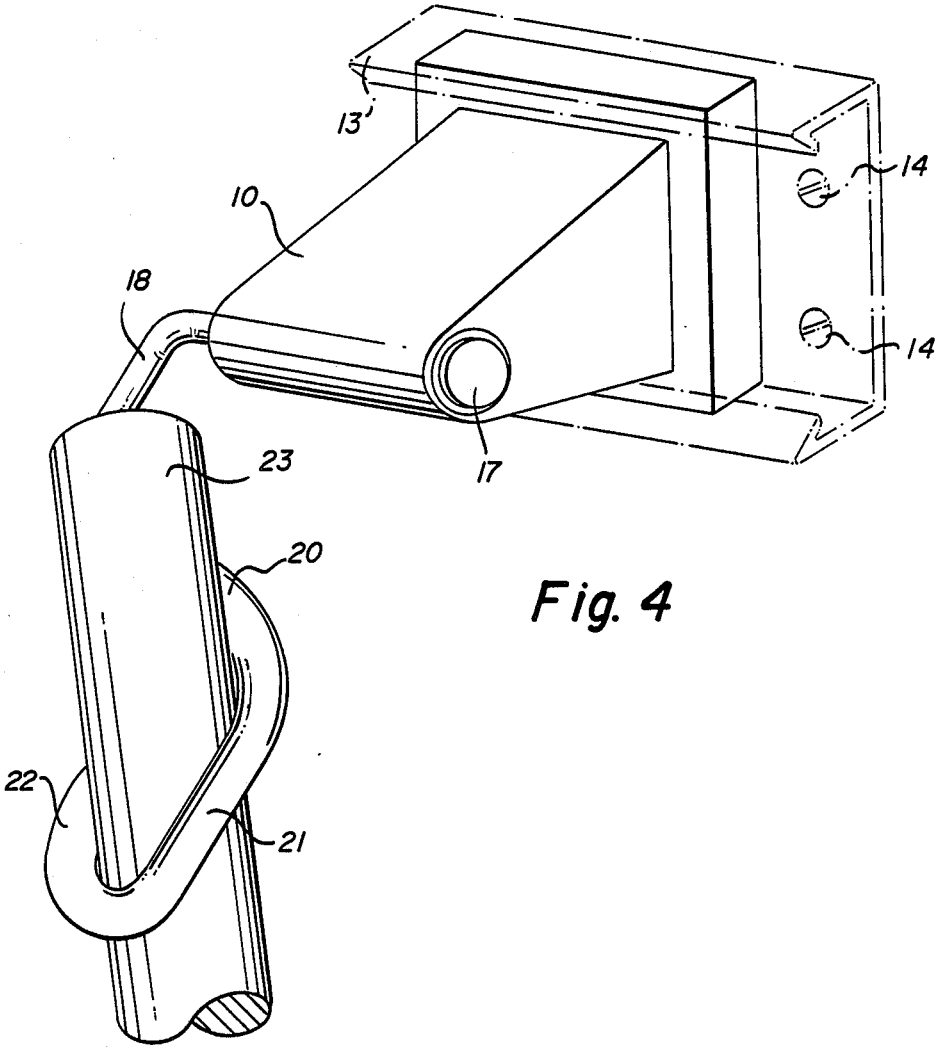
FIG. 4 is a perspective view similar to FIG. 1 of a second embodiment of a device in accordance with the present invention but in its operative position and supporting the handle of a tool.
Figure 5:
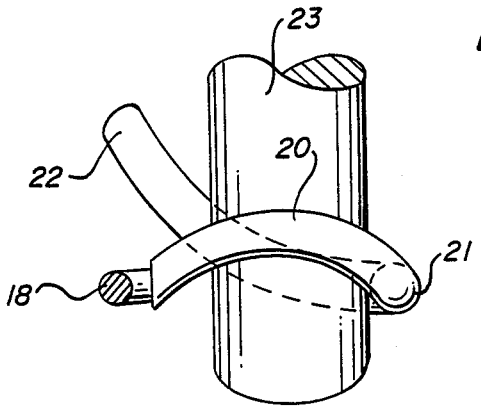
FIG. 5 is a vertical cross-sectional view through the device and handle shown in FIG. 4, taken along a line corresponding to the line III—III in FIG. 2.

The remainder of the hook assembly is formed by bending a steel rod or the like to shape and comprises a plurality of different portions. Extending substantially at right angles to the mounting shaft 11 is a first, rectilinear portion 18. A C-shaped or S-shaped portion 19 as shown in FIGS. 1 to 3 of the drawing or a part-circular bowed portion 20 as shown in FIGS. 4 and 5 of the drawing is attached to the rectilinear portion 18. The C-shaped or S-shaped portion 19 and the part-circular bowed portion 20 each have a concave curvature in that the ends of the portions are bowed outwardly (out of the plane of FIG. 2 as shown) as can be seen from the cross-sectional views shown in FIGS. 3 and 5.

In the embodiment shown in FIG. 2, the first, rectilinear, portion 18 extends substantially vertically while the C-shaped or S-shaped portion 19 extends in a horizontal plane. In the arrangment shown in FIG. 5, the first linear portion 18 again extends vertically whilst the part-circular bowed portion 20 extends in a horizontal plane.

In both embodiments, a second linear portion 21, which in the arrangement shown in FIG. 2 also extends vertically, extends from the S-shaped portion 19 or the partially circular bowed portion 20 to a continuously curved three-dimensional portion 22 which forms the free end of the hook. The three-dimensional portion 22 is not only curved in the plane of FIG. 2 of the drawing but also the end portion extends rearwardly (into the plane of FIG. 2 as shown) as can be seen from the cross-sectional view shown in FIG. 3 to form a convex curvature.

As a result of the curvature of the upper portion 19 or 20 on the one hand, and of the lower three-dimensional portion 22 on the other hand, a tool handle 23 which is suspended from the hook is pressed against the second linear portion 21 on on the inner side thereof by virtue of its own weight. There are therefore a total of three points or lines of engagement of the handle 23 within the hook, namely these being against portion 19 or 20, against the lower three-dimensional portion 22 and the other or middle linear portion 21. This increases the frictional force between handle 23 and the hook. A resilient sheath may be provided around the steel rod, such as a plastics material sleeve, to increase the area of contact between the hook and the handle, and therefore to increase the frictional retention of the handle.

The radius of curvature of the C-shaped, S-shaped or bowed portion 19 or 20 and/or of the lower three-dimensionally curved portion 22 is generally of substantially the same size or greater than the surface curvature of the handle 23. However, it may be made slightly smaller than that of the handle so that a slight clamping effect is achieved.

We claim:

1. A device for suspending handled tools such as brooms, spades and rakes, comprising:
   - hook means; and
   - mounting means for said hook means,
   - said mounting means defining a pivot axis for said hook means, said pivot axis extending substantially horizontally, said hook means having:
     - a front elevation which is substantially S-shaped and having a mounting shaft portion located in said mounting means so as to be pivotable about said horizontal axis,
     - a linear portion extending substantially at a right angle from said mounting shaft portion in a generally downward direction,
     - another portion extending from said linear portion, said another portion being substantially C-shaped, and
     - a hook portion extending from said another portion, wherein said another portion is curved in three dimensions and has a first leg being in a concaved curvature, an intermediate leg being straight, and a third leg being in a convexed curvature, and wherein said hook portion is directed generally inwardly.

2. A device as recited in claim 1, wherein the radius of curvature of said first leg and said third leg of said another portion is not less than the curvature of the surface of the handle of the tool to be suspended.

3. A device as recited in claim 1, wherein the radius of curvature of said first leg and said third leg of said another portion is smaller than the curvature of the surface of the handle of the tool to be suspended.

4. A device as recited in one of claims 1 to 3, wherein said hook portion includes a portion extending substantially at right angles to said another portion.

5. A device as recited in one of claims 1 to 3, wherein said hook portion includes a continuously curved three-dimensional hook, and wherein said C-shaped portion is curved towards the three-dimensional curvature of said hook.

6. A device as recited in one of claims 1 to 3, wherein the handle of the tool being suspended subtends an acute angle with said intermediate leg of said another portion.

7. A device as recited in one of claims 1 to 3, wherein said mounting means comprises a mounting block and rail means for receiving said mounting block to thereby permit said block to be displaced substantially horizontally along said rail means.

8. A device as recited in one of claims 1 to 3, further comprising:

a coil spring surrounding said mounting shaft within said mounting block, said spring having a first end secured to said mounting block and a second opposing end; and collar means on said mounting shaft for fixedly connecting with said second end of said spring.

* * * * *

UNITED STATES PATENT AND TRADEMARK OFFICE

CERTIFICATE OF CORRECTION

PATENT NO. : 4,880,192

DATED : November 14, 1989

INVENTOR(S) : VOM BRAUCKE et al

It is certified that error appears in the above-identified patent and that said Letters Patent is hereby corrected as shown below:

On the cover page, after Item [22], add the following:

--[30] Foreign Application Priority Data

Feb. 7, 1987 [DE] Fed. Rep. of Germany.....8701865--.

Signed and Sealed this

Twelfth Day of February, 1991

*Attest:*

HARRY F. MANBECK, JR.

*Attesting Officer*

*Commissioner of Patents and Trademarks*